US010166762B2

(12) United States Patent
Kujiraoka

(10) Patent No.: US 10,166,762 B2
(45) Date of Patent: Jan. 1, 2019

(54) IMAGE FORMING APPARATUS WITH NOZZLES DISCHARGING INKS EACH HAVING BRIGHTNESS, METHOD FOR FORMING IMAGE WITH INKS EACH HAVING BRIGHTNESS, AND PROGRAM

(71) Applicant: SEIKO EPSON CORPORATION, Tokyo (JP)

(72) Inventor: Yoichi Kujiraoka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/435,913

(22) Filed: Feb. 17, 2017

(65) Prior Publication Data

US 2017/0239939 A1 Aug. 24, 2017

(30) Foreign Application Priority Data

Feb. 24, 2016 (JP) ..... 2016-033254

(51) Int. Cl.
*B41J 2/045* (2006.01)
*B41J 2/21* (2006.01)

(52) U.S. Cl.
CPC ..... *B41J 2/04536* (2013.01); *B41J 2/04586* (2013.01); *B41J 2/2103* (2013.01); *B41J 2/2107* (2013.01); *B41J 2/2121* (2013.01)

(58) Field of Classification Search
CPC .... B41J 2/04536; B41J 2/2121; B41J 2/2107; B41J 2/04586; B41J 2/2103
See application file for complete search history.

(56) References Cited

U.S. PATENT DOCUMENTS

2008/0154392 A1 6/2008 Maenishi et al.
2008/0216684 A1* 9/2008 Horai ..... H04N 1/40087 101/202
2012/0075374 A1* 3/2012 Szafraniec ..... H04N 1/4078 347/15

FOREIGN PATENT DOCUMENTS

JP 2009-027204 A 2/2009
JP 2010-179626 A 8/2010

OTHER PUBLICATIONS

The Extended European Search Report for the corresponding European Patent Application No. 17157790.1 dated Jul. 31, 2017.

* cited by examiner

*Primary Examiner* — Bradley Thies

(57) ABSTRACT

An image forming apparatus includes a head unit that moves in a predetermined scanning direction and on which a first nozzle which discharges first ink including a black color material, a second nozzle which discharges second ink having higher brightness than that of the first ink, and a third nozzle which discharges third ink having higher brightness than that of the first ink are arrayed in the scanning direction, and a control portion. The control portion is set to perform a conversion processing which sets a type and amount of the ink which is discharged from the head unit according to color data included in the image data and use the first ink, the second ink, and the third ink according to the color data of the darkest point in the conversion processing.

9 Claims, 8 Drawing Sheets

FIG. 7

| UNIDIRECTIONAL PRINTING | | | | | |
|---|---|---|---|---|---|
| NOZZLE USE PROPORTION [%] | | | DENSITY EVALUATUION (A OR B) | UNEVENNESS EVALUATION (A TO C) | OVERALL EVALUATION (A OR B) |
| Mk | Lk | MLk | | | |
| 90 | 5 | 5 | A | A | A |
| 90 | 10 | 10 | A | A | A |
| 90 | 15 | 15 | A | A | A |
| 90 | 20 | 20 | A | C | B |
| 90 | 25 | 25 | B | C | B |
| 95 | 5 | 5 | A | A | A |
| 95 | 10 | 10 | A | A | A |
| 95 | 15 | 15 | A | A | A |
| 95 | 20 | 20 | A | A | A |
| 95 | 25 | 25 | B | A | B |

FIG. 8

| BIDIRECTIONAL PRINTING | | | | | |
|---|---|---|---|---|---|
| NOZZLE USE PROPORTION [%] | | | DENSITY EVALUATUION (A OR B) | UNEVENNESS EVALUATION (A TO C) | OVERALL EVALUATION (A OR B) |
| Mk | Lk | MLk | | | |
| 90 | 5 | 5 | A | A | A |
| 90 | 10 | 10 | A | A | A |
| 90 | 15 | 15 | A | A | A |
| 90 | 20 | 20 | B | C | B |
| 90 | 25 | 25 | B | C | B |
| 95 | 5 | 5 | A | A | A |
| 95 | 10 | 10 | A | A | A |
| 95 | 15 | 15 | A | A | A |
| 95 | 20 | 20 | B | A | B |
| 95 | 25 | 25 | B | A | B |

IMAGE FORMING APPARATUS WITH NOZZLES DISCHARGING INKS EACH HAVING BRIGHTNESS, METHOD FOR FORMING IMAGE WITH INKS EACH HAVING BRIGHTNESS, AND PROGRAM

BACKGROUND

1. Technical Field

The present invention relates to an image forming apparatus, a method for forming an image, and a program.

2. Related Art

An ink jet printer (hereinafter, also referred to as "printer") is known as an example of an image forming apparatus. There is a printer which discharges ink droplets from a nozzle of a head unit while the head unit reciprocating in a main scanning direction and thus forms a printed image on a printing medium (for example, JP-A-2010-179626).

Miniaturization of discharged ink droplets is progressing in order to achieve high-definition of the printed image in the printer. There is a case where ink droplets having the miniaturized sizes are discharged in combination with ink droplets having large sizes in order to form large dots. Wind pressure by discharge of the ink droplets is also generated between the head unit and the printing medium in the printer in which the head unit described above reciprocates in the main scanning direction, in addition to wind pressure generated by movement of the head unit. In particular, in a case where ink droplets having large sizes are continuously discharged, there is a case where disturbance of large air flow is generated by the wind pressure accompanying the movement of the head unit and the wind pressure accompanying the discharge of the ink droplets. Therefore, in a case where the ink droplets having large sizes and the ink droplets having miniaturized sizes are discharged from the different nozzles from each other at the same time or continuously, there is a possibility that landing positions of ink droplets having the miniaturized sizes are deviated from the target position by disturbance of air flow as described above. When deviation of the landing position of ink droplets having the miniaturized sizes described above increases, density unevenness in the printed image is likely to be generated. There is a case where the density unevenness described above is similar to a pattern that can be formed on the surface of sandy land or the like by wind and thus is also referred to as "wind ripple".

In a technology of JP-A-2010-179626, although the disturbance of air flow generated by the movement of the head unit is considered, disturbance of air flow generated by the discharge of the ink droplets is not considered at all. In a technology of JP-A-2010-179626, a movable member is provided on the head unit which generates air flow in a moving direction of the head unit in order to suppress the generation of the disturbance of air flow between the head unit and the printing medium. However, in a case where the moving member is added to the head unit, there is a possibility that new problems such as increase in size, weight, and manufacturing cost of the head unit and the printer, or the like are generated. Therefore, there is still room for improvement for a technology of suppressing generation of density unevenness in the printed image due to the deviation of the landing positions of the ink droplets.

SUMMARY

The invention can be realized in the following aspects.

According to a first aspect of the invention, an image forming apparatus is provided. The image forming apparatus may form an image on a medium based on image data. The image forming apparatus may include a head unit and a control portion. The head unit may move in a predetermined scanning direction and a first nozzle which discharges first ink including a black color material, a second nozzle which discharges second ink having higher brightness than that of the first ink, and a third nozzle which discharges third ink having higher brightness than that of the first ink may be arrayed on the head unit in the scanning direction. The control portion may perform image forming processing which forms the image on the medium by discharging ink from the head unit and thus forming dot array while moving the head unit in the scanning direction. The control portion may be set to perform a conversion process which sets a type and an amount of the ink which is discharged from the head unit according to color data included in the image data and to use the first ink, the second ink, and the third ink with respect to the color data representing the darkest point in the conversion process. According to the image forming apparatus of the aspect, a deviation of a landing position of at least one of ink droplets of the second ink and ink droplets of the third ink are suppressed by using the second ink and the third ink, in addition to the first ink to an image area which is formed using ink including black color material. Accordingly, generation of density unevenness is suppressed in the image which is formed on the medium.

In the image forming apparatus of the first aspect, the first nozzle may be positioned between the second nozzle and the third nozzle in the scanning direction. According to the image forming apparatus of the aspect, any one of the second nozzle and the third nozzle is positioned in an upstream side of the first nozzle in the moving direction of the head unit. Therefore, even in a case where the large disturbance of the air flow is generated in a downstream side of the first ink, generation of the density unevenness in the image which is formed on the medium is suppressed, since the deviation of the landing position of at least one of the ink droplets of the second ink and the ink droplets of the third ink is suppressed.

In the image forming apparatus of the first aspect, in a case where the scanning direction is a first scanning direction and a direction which is opposite to the first scanning direction is a second scanning direction, the control portion may selectively perform a first image forming processing that forms the image by discharging the ink from the head unit, only while moving the head unit in the first scanning direction, and a second image forming processing that forms the image by combining a first scanning processing which discharges the ink from the head unit while moving the head unit in the first scanning direction and a second scanning processing which discharges the ink from the head unit while moving the head unit in the second scanning direction. According to the image forming apparatus of the aspect, in each of the first image forming processing and the second image forming processing, the generation of density unevenness is suppressed in the image that is formed on the medium.

In the image forming apparatus of the first aspect, in a case where an actual proportion of a discharging amount of ink of the nozzle per a unit area to the maximum value of ink amount which is capable of being discharged per the unit area on the medium from the same nozzle is used as a nozzle use proportion, the nozzle use proportion in the second nozzle when the image area having the darkest point is formed may be equal to or greater than 5%. The nozzle use proportion in the second nozzle when the image area having the darkest point is formed may be equal to or less than 15%. According to the image forming apparatus of the aspect, in the image which is formed on the medium, generation of density unevenness can be suppressed while decrease in density of the black color is suppressed.

In the image forming apparatus of the first aspect, in a case where an actual proportion of a discharging amount of ink of the nozzle per a unit area to the maximum value of ink amount which is capable of being discharged per the unit area on the medium from the same nozzle is used as a nozzle use proportion, the nozzle use proportion in the third nozzle when the image area having the darkest point is formed may be equal to or greater than 5%. The nozzle use proportion in the third nozzle when the image area having the darkest point is formed may be equal to or less than 15%. According to the image forming apparatus of the aspect, in the image which is formed on the medium, generation of density unevenness can be suppressed while decrease in density of the black color is suppressed.

In the image forming apparatus of the first aspect, in a case where an actual proportion of a discharging amount of ink of the nozzle per a unit area to the maximum value of ink amount which is capable of being discharged per the unit area on the medium from the same nozzle is used as a nozzle use proportion, the nozzle use proportion in the first nozzle when the image area having the darkest point is formed may be equal to or greater than 90%. The nozzle use proportion in the first nozzle when the image area having the darkest point is formed may be equal to or less than 95%. According to the image forming apparatus of the aspect, in the image which is formed on the medium, generation of density unevenness can be suppressed while decrease in density of the black color is suppressed. In addition, the using amount of the first ink can be reduced.

In the image forming apparatus of the first aspect, the head unit may further include a fourth nozzle which discharges a fourth ink including black color material, and the control portion may select the fourth ink as ink in place of the first ink, based on the type of a medium. According to the image forming apparatus of the aspect, ink of a type which is suitable for the type of a medium can be used as ink representing black color using the black color material.

In the image forming apparatus of the first aspect, the head unit may further include a fifth nozzle which discharges a fifth ink of which density is lower than that of the third ink, and the first nozzle may be positioned between the second nozzle and the third nozzle and the third nozzle may be positioned between the first nozzle and the fifth nozzle in the scanning direction. According to the image forming apparatus of the aspect, image quality of the image which is formed on the medium can be increased by using the fifth ink. In addition, degradation of image quality is suppressed by the first ink being mixed in the fifth nozzle, since the fifth nozzle is provided in a position which is spaced apart from the first nozzle which discharges the first ink of which density is high.

In the image forming apparatus of the first aspect, the second ink and the third ink may be ink having achromatic color. The head unit may further include a first color ink nozzle which discharges a first ink having chromatic color and a second color ink nozzle which discharges a second ink having chromatic color, and the first nozzle, the second nozzle, and the third nozzle may be positioned between the first color ink nozzle and the second color ink nozzle in the scanning direction. According to the image forming apparatus of the aspect, in an image area in which the second ink and the third ink are used, along with the first ink, so called degradation of tint such as color transition can be suppressed, since the second ink and the third ink are achromatic colors. In addition, according to the image forming apparatus of the aspect, the first color ink nozzle and the second color ink nozzle can be provided in a position which is spaced apart from the first nozzle. Accordingly, it is suppressed that trajectory of the ink droplets which are discharged from the first color ink nozzle and the second color ink nozzle is affected by wind pressure which is generated by discharge of ink from the first nozzle.

According to a second aspect of the invention, a method for forming an image is provided. This method may be a method which forms an image on a medium based on image data. This method may include converting and forming an image. The converting may be a process for setting a type and an amount of ink which is discharged from the head unit, according to color data included in the image data. The forming the image may be a process for forming the image on the medium by discharging ink from the head unit and thus forming a dot array using the type and the amount of the ink which is set in the converting, while moving the head unit in a predetermined scanning direction. The converting may be a process for setting to use a first ink including black color material, a second ink of which brightness is higher than the first ink, and a third ink of which brightness is higher than the first ink with respect to the color data representing the darkest point. According to the method of the second aspect, generation of density unevenness is suppressed in an image area which is formed by using ink including the black color material, by using the second ink and the third ink, in addition to the first ink.

According to a third aspect of the invention, a program for controlling an image forming apparatus that forms an image on a medium by discharging ink from a head unit toward the medium while moving the head unit in a predetermined scanning direction is provided. This program may execute a converting function and the image forming function in a computer which controls the image forming apparatus. The converting function may be a function which sets a type and an amount of ink which is discharged from the head unit according to color data included in image data. The image forming function may be a function which discharges ink from the head unit using the type and the amount of the ink which is set by the converting function, while the head unit moves in the scanning direction. The converting function may include a function which sets to use a first ink including black color material, a second ink of which brightness is higher than the first ink, and a third ink of which brightness is higher than the first ink with respect to the color data representing the darkest point. According to the program of the third aspect, generation of density unevenness is suppressed in an image area which is formed by the image forming apparatus using ink including the black color material.

The invention can be realized in various forms in addition to the image forming apparatus, the method for forming an image, and the program. For example, a printing apparatus, a printing method, a method for discharging ink, a method for processing a half tone, a method for controlling the image forming apparatus or the printing apparatus, a program for executing these methods, a recording medium which is non-transient and in which the program is stored.

BRIEF DESCRIPTION OF THE DRAWINGS

The invention will be described with reference to the accompanying drawings, wherein like numbers reference like elements.

FIG. 7 is an explanatory diagram illustrating an evaluation result of the printed image by the unidirectional printing.

FIG. 8 is an explanatory diagram illustrating an evaluation result of the printed image by the bidirectional printing.

DESCRIPTION OF EXEMPLARY EMBODIMENTS

Figure 1:
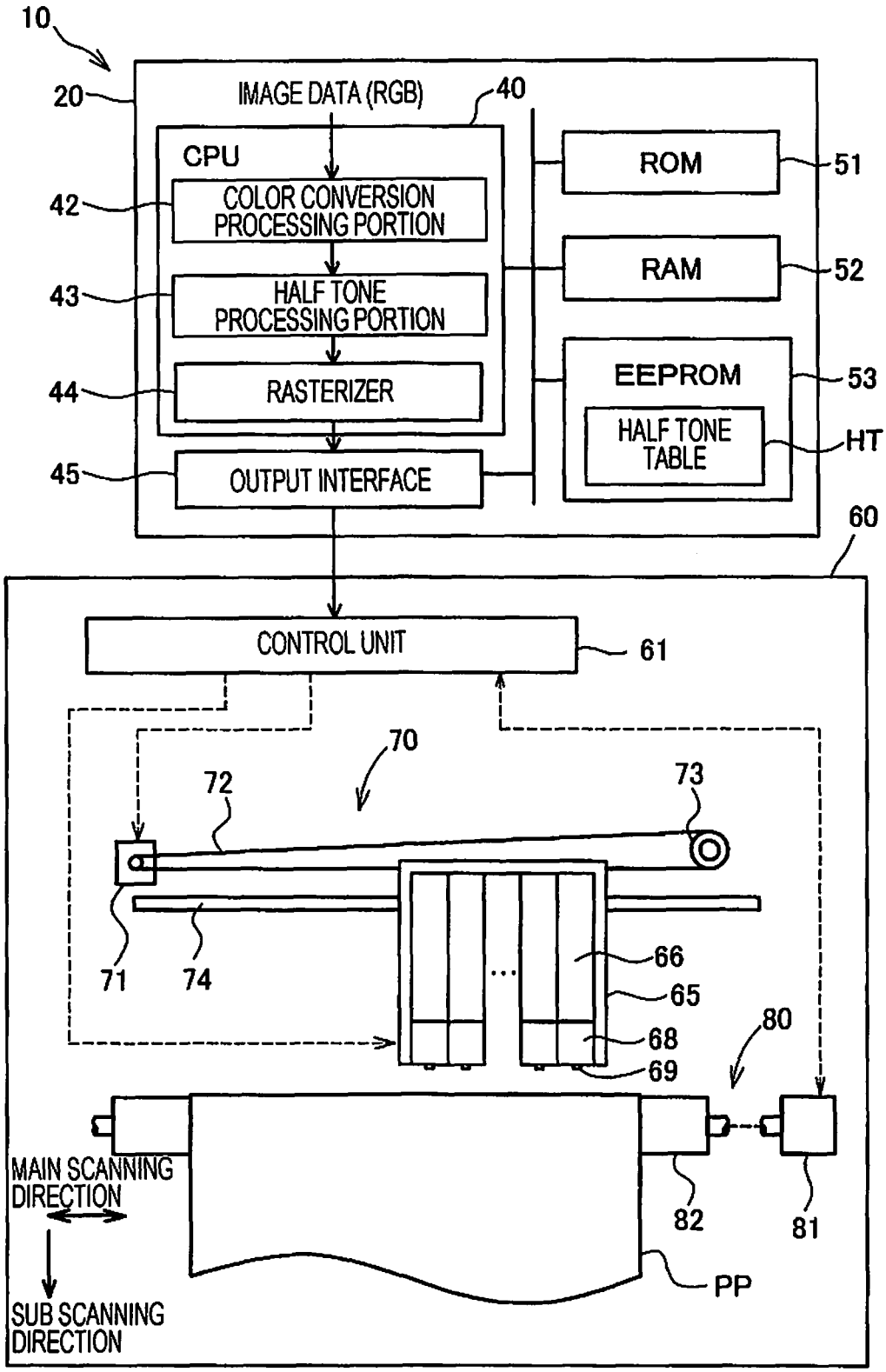
FIG. 1 is an explanatory diagram illustrating a configuration of an image forming apparatus.

A. Embodiment:

FIG. 1 is an explanatory diagram illustrating a configuration of an image forming apparatus 10 according to a first embodiment of the invention. In the present embodiment, an image forming apparatus 10 is an ink jet printer. The image forming apparatus 10 forms a printed image by discharging ink droplets based on image data which is input from an outside portion of the image forming apparatus 10 and thus recording ink dots (hereinafter, simply referred to as "dot") on a printing paper PP which is a medium. The image forming apparatus 10 includes an image processing unit 20 and a recording unit 60. The image processing unit 20 generates dot recoding data which represents a recording state of the dot including color, a size, a position, or the like of the dot which is formed on the printing paper PP from image data.

The image processing unit 20 is configured as a microcomputer. The image processing unit 20 includes a control portion 40, a RON 51, a RAM 52, an EEPROM 53, and an output interface 45. A control portion 40 is configured by a central processing unit (CPU) and functions as a color conversion processing portion 42, a half tone processing portion 43 and a rasterizer 44 by reading and executing various programs and instructions at the RAM 52.

A color conversion processing portion 42 converts the input image data into a digital image data of color space which corresponds to ink color which is used in the recording unit 60, by referring to a lookup table (LUT) which is prepared in advance. In the present embodiment, the color conversion processing portion 42 converts RGB image data into CHYK image data. RGB image data is configured by information on luminance for each of red (R), green (G), and blue (B) for each pixel which constitutes an image. CMYK image data is configured by information on gradation values of cyan (C), magenta (M), yellow (Y), and black (K) for each pixel which constitutes an image.

The half tone processing portion 43 writes dot data which represents a state where dots having a plurality of colors which constitutes the printed image are arrayed by a half tone processing being performed with respect to the image data after color conversion. The dot data corresponds to a data which represents a type and an amount of ink used when the printed image is formed. The half tone processing portion 43 refers to the half tone table HT (to be described below) which is stored in the EEPROM 53 in advance in the half tone processing. The half tone processing corresponds to a subordinate concept of the conversion processing in the invention and a function which is realized by the half tone processing portion 43 corresponds to a conversion function in the invention.

The rasterizer 44 writes raster data which reconstructs the dot data which is generated at the half tone processing in order of formation of dots in the recording unit 60. The raster data can be interpreted as data representing allocation of ink discharge of each nozzle 69 in a head unit 68 in the forming processing of the printing medium. The control portion 40 outputs the dot recording data including the raster data and a data which represents the feed amount of the printing paper PP to the recording unit 60 through the output interface 45.

The recording unit 60 includes a control unit 61, a carriage 65, a head movement mechanism 70, and a medium transporting mechanism 80. The control unit 61 forms the printed image on the printing paper PP by controlling operation of the head unit 68, the head movement mechanism 70, and the medium transporting mechanism 80, based on the dot recording data which is acquired from the image processing unit 20. It can be interpreted that the image forming function which forms the printed image on the printing paper PP is realized by the control unit 61, eventually by a control portion 40, in the image forming apparatus 10 according to the present embodiment.

A plurality of colors of ink cartridges 66 are mounted on an upper portion of the carriage 65 and the head unit 68 is provided on a lower portion of the carriage 65. The head unit 68 includes a nozzle array on which nozzles 69 corresponding to each color ink cartridge 66 described above on a lower surface thereof is arrayed. The ink color which is supplied from the corresponding ink cartridge 66 is discharged from each nozzle 69 of the head unit 68. The type of color ink which is discharged by the head unit 68 and an array configuration of the nozzle 69 in a lower surface of the head unit 68 will be described below.

The carriage 65 is held so as to be capable of reciprocating in a predetermined scanning direction by the head movement mechanism 70. The head movement mechanism 70 includes a carriage motor 71, a driving belt 72, a pulley 73, and a guide shaft 74. The driving belt 72 is stretched between the carriage motor 71 and the pulley 73. The carriage 65 is attached to the driving belt 72. The guide shaft 74 is a member having a rod shape which guides movement of the carriage 65, is disposed along the driving belt 72 and penetrates the carriage 65.

The carriage 65 linearly reciprocates along the guide shaft 74 by the carriage motor 71 driving the driving belt 72. The direction of the reciprocating movement is referred to as "main scanning direction". The ink cartridge 66 and the head unit 68 also move in the main scanning direction along the movement of the carriage 65 in the main scanning direction. When the carriage 65 is moved in the main scanning direction, the dots are recorded on the printing paper PP by ink being discharged on the printing paper PP from the nozzle 69 of the head unit 68 and thus the dot array is formed. The movement of the head unit 68 in the main scanning direction and the discharge of the ink are referred to as main scanning and one main scanning is also referred to as "pass".

The main scanning direction includes a forward path direction which is a first scanning direction and a backward path direction which is a second scanning direction which is opposite to the forward path direction. The recording unit 60 according to the present embodiment is capable of selectively performing a unidirectional printing which performs the discharge of the ink only when moving in the forward path direction of the main scanning direction and a bidirectional printing which performs the discharge of the ink on the movement of the forward path direction and the movement of the backward path direction, respectively. In the unidirectional printing, one pass is configured by only the main scanning in the forward path direction, and in the bidirectional printing, one pass is configured by combination of the main scanning in the forward path direction and the main scanning in the backward path direction.

The printing paper PP is transported in the direction which is intersected with the main scanning direction in the lower side of the head unit 68 by the medium transporting mechanism 80, when printed image is formed in the recording unit 60. The transport direction of the printing paper PP is referred to as "sub scanning direction". In the present embodiment, the sub scanning direction is perpendicular to the main scanning direction. However, the sub scanning direction may not necessarily have to be perpendicular to the main scanning direction and may be intersected with the main scanning direction.

The medium transporting mechanism 80 includes a paper feeding motor 81 and a paper feeding roller 82. The paper feeding motor 81 is connected to the paper feeding roller 82. When image is formed, the printing paper PP is inserted on the side surface of the paper feeding roller 82. When the printed image is formed, if one pass operation is completed, the control unit 61 rotates the paper feeding motor 81 and the printing paper PP is moved in the sub scanning direction according to information of amount of feed amount which is included in the dot recording data. The printed image is formed by repetition of the main scanning by the head unit 68 and the transport in the sub scanning direction of the printing paper PP in the recording unit 60.

Figure 2:
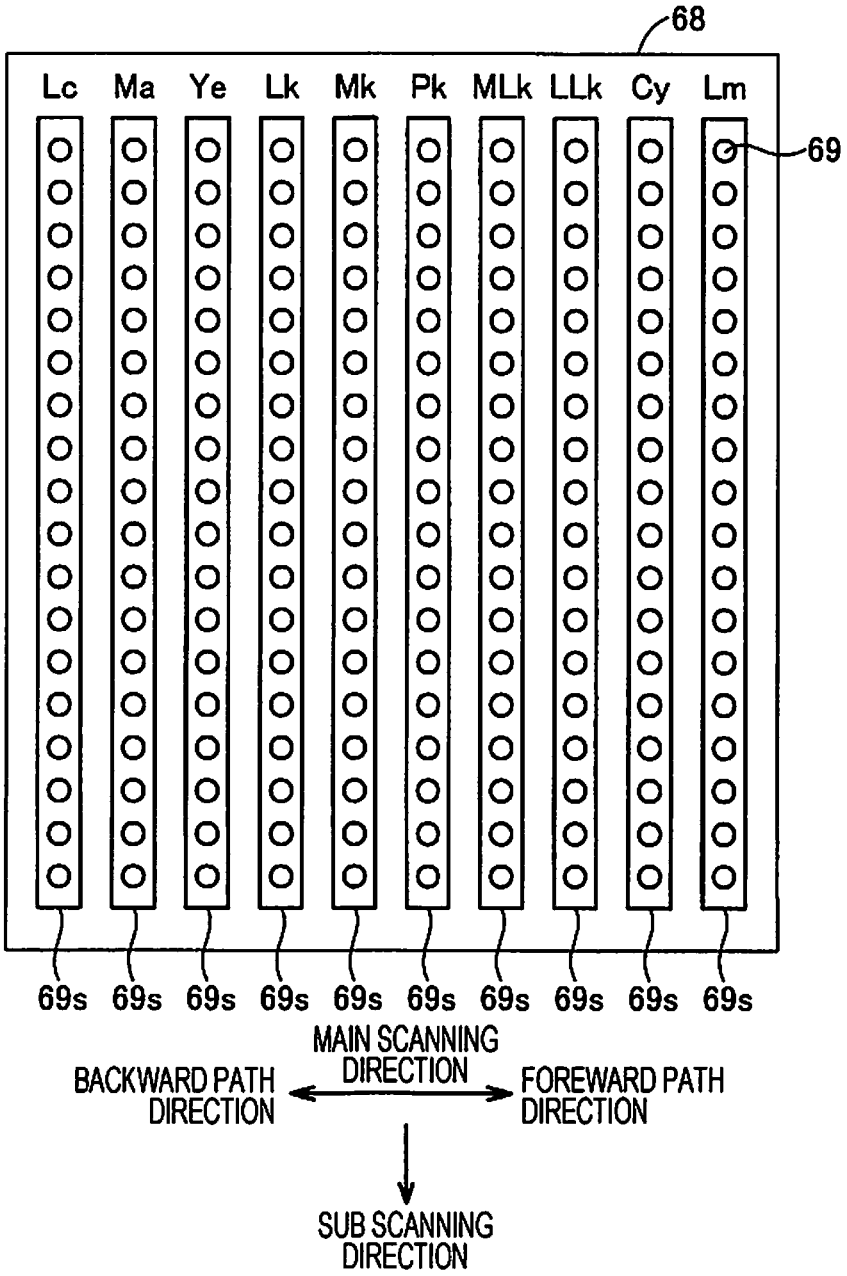
FIG. 2 is an explanatory diagram illustrating an example of an array configuration of nozzles in the head unit.

FIG. 2 is an explanatory diagram illustrating an example of an array configuration of nozzles in the head unit 68. An example of an array configuration of the nozzle 69 in the head unit 68 when viewed in a direction from the head unit 68 toward the printing paper PP is schematically illustrated in FIG. 2. In addition, in FIG. 2, for convenience, arrows which represent the main scanning direction and the sub scanning direction are illustrated.

Nozzle arrays 69*s* for each color of ink in which a plurality of nozzles 69 are arrayed in a row in the sub scanning direction are arrayed in the main scanning direction in the head unit 68 according to the present embodiment. In the present embodiment, the nozzle arrays 69*s* are arrayed in the order of light cyan (Lc), magenta (Ma), yellow (Ye), gray (Lk), matte black (Mk), photo black (Pk), intermediate gray (MLk), light gray (LLk), cyan (Cy), light magenta (Lm) in the forward path direction in the main scanning direction.

Mk and Pk are ink which includes black color material, respectively. In the present embodiment, the nozzle array 69*s* of Mk and the nozzle array 69*s* of Pk are adjacent to each other in the main scanning direction. Any one of Mk and Pk is used, as ink including the black color material, according to the type of the printing paper PP in the image forming apparatus 10. In the present embodiment, for example, with respect to the printing paper PP of a type of the surface glossy feeling being relatively low, such as ink jet paper and plain paper, matte paper which is performed matting treatment on surfaces thereof, or the like, as ink including the black color material, Mk is used. On the other hand, for example, with respect to the printing paper PP which has relatively high surface glossy feeling by a coating treatment being performed in order to provide glossy feeling on the surfaces such as photo paper and glossy paper, Pk is used. Mk corresponds to subordinate concept of first ink and a nozzle 69 of Mk corresponds to subordinate concept of a first nozzle in the invention. Pk corresponds to subordinate concept of fourth ink and a nozzle 69 of Pk corresponds to subordinate concept of a fourth nozzle in the invention.

Lk, MLk, and LLk are gray ink representing a color of an intermediate gradation between white and black and the density thereof gradually increases in the order of LLk, MLk, and Lk and the color thereof approaches black in the order of LLk, MLk, and Lk. "Density" in the present specification means optical density (OD value), unless otherwise specified. In other words, Lk, MLk, and LLk are an ink having a brightness which is higher than Mk, respectively and the brightness gradually increases in the order of LLk, MLk, and Lk. In the present embodiment, the nozzle array 69*s* of Lk is positioned in the side of backward path direction with respect to the nozzle array 69*s* of Mk. The nozzle array 69*s* of MLk is positioned in the forward path direction of the nozzle array 69*s* of Mk with the nozzle array 69*s* of Pk being provided between the nozzle array 69*s* of MLk and the nozzle array 69*s* of Mk with the nozzle array 69*s*. The nozzle array 69*s* of LLk is positioned in the forward path direction side of the nozzle array 69*s* of Mk. Lk which has the highest density except for Mk and Pk corresponds to subordinate concept of second ink in the invention and the nozzle 69 of Lk corresponds to subordinate concept of second nozzle in the invention. MLk which has the highest density except for Lk corresponds to subordinate concept of third ink in the invention and the nozzle 69 of MLk corresponds to subordinate concept of third nozzle in the invention. LLK which has the lowest density corresponds to subordinate concept of fifth ink in the invention and the nozzle 69 of LLK corresponds to subordinate concept of a fifth nozzle in the invention.

Mk, Pk, Lk, MLk, and LLk described above are achromatic color ink, respectively. On the contrary, Lc, Ma, Ye, Cy, and Lm are chromatic color ink, respectively. The nozzle arrays 69*s* of Lc, Ma, and Ye are arrayed in the order of Lc, Ma, and Ye in the forward path direction in the backward path direction side of the nozzle array 69*s* of Lk. The nozzle arrays 69*s* of Cy and Lm are arrayed in the order of Cy and Lm in the forward path direction in the forward path direction side of the nozzle array 69*s* of LLk. Therefore, in the present embodiment, the nozzle arrays 69*s* of achromatic color ink (Mk, Pk, Lk, MLk, and LLk) are provided between the nozzle arrays 69*s* of the chromatic color ink (Lc, Ma, Ye, Cy, and Lm) in the main scanning direction. The nozzle arrays 69*s* of Lc, Ma, and Ye correspond to the first color ink nozzle which discharges a first chromatic color ink in the invention and the nozzle arrays 69*s* of Cy and Lm correspond to a second color ink nozzle which discharges a second chromatic color ink in the invention.

Figure 3:
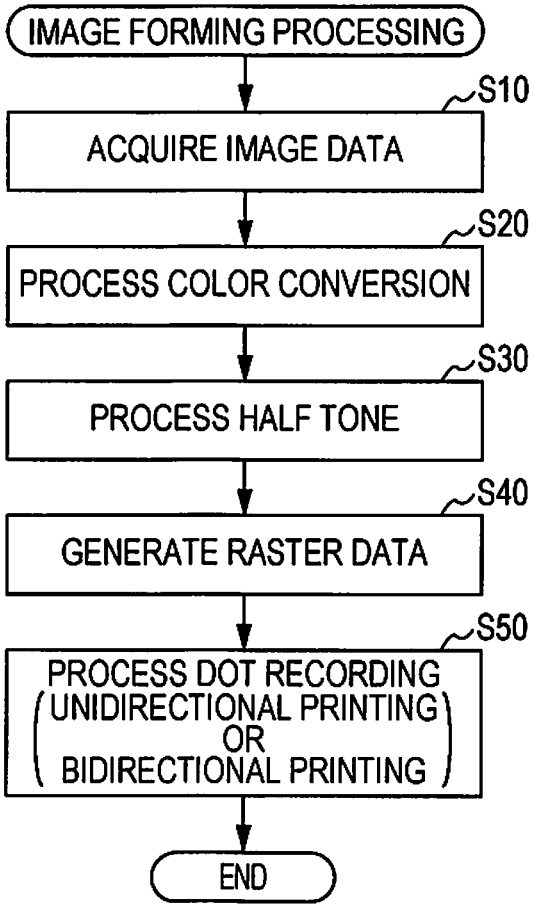
FIG. 3 is an explanatory diagram illustrating flow of an image forming processing.

FIG. 3 is an explanatory diagram illustrating a flow of an image forming processing performed in the image forming apparatus 10. In step S10, the control portion 40 acquires the image data from an outside portion of the image forming apparatus 10 through a storage medium such as a SD card or a USB memory, or a network. In the step S20, the color conversion processing portion 42 performs the color conversion processing described above.

In step S30, the half tone processing portion 43 performs the half tone processing with respect to the image data after the color conversion processing using the half tone table HT and thus generates the dot data. The dot data is generated at least in order to use Lk and MLk, in addition to Mk (or Pk) in a black color image area which represents the darkest point in order to control generation of density unevenness in the printed image, in the half tone processing in the present embodiment. For example, the gradation value of each component of R, G, and B becomes 0 ((R, G, B)=(0, 0, 0)) in the image area having the darkest point in RGB image data. Details of the processing of step S30 and reasons for performing the processing will be described below. The process of the step S30 corresponds to the conversion process in the invention.

In step S40, the rasterizer 44 generates the raster data from the dot data generated at the step S30. In step S50, the recording unit 60 performs the dot recording processing, based on the dot recording data including the raster data. The recording unit 60 forms an image represented in the dot data as the printed image, by recording dots on the printing paper PP, by repeating the main scanning and transport in the sub scanning direction of the printing paper PP by the carriage 65, based on the dot recording data. The process of the step S50 corresponds to a subordinate concept of the image forming process in the invention.

As described above, the unidirectional printing and the bidirectional printing are capable of selectively being performed in the image forming apparatus 10 in the present embodiment. A user of the image forming apparatus 10 can specify whether or not to select any method of the unidirectional printing and bidirectional printing through a user interface (not illustrated) of the image forming apparatus 10 before start of the image forming processing. The rasterizer 44 generates the dot recording data for the unidirectional printing or the dot recording data for the bidirectional printing according to specification of the user. Accordingly, any of the unidirectional printing or the bidirectional printing is performed in the dot recording processing of step S50. High image quality of the printed image can be obtained in a case of the unidirectional printing and printing speed can be improved in a case of the bidirectional printing. The unidirectional printing corresponds to the first image forming processing in the invention and the bidirectional printing corresponds to the second image forming processing in the invention. In addition, the main scanning in the forward path direction in the bidirectional printing corresponds to the first scanning processing in the invention and the main scanning in the backward path direction in the bidirectional printing corresponds to the second scanning processing in the invention.

Figure 4:
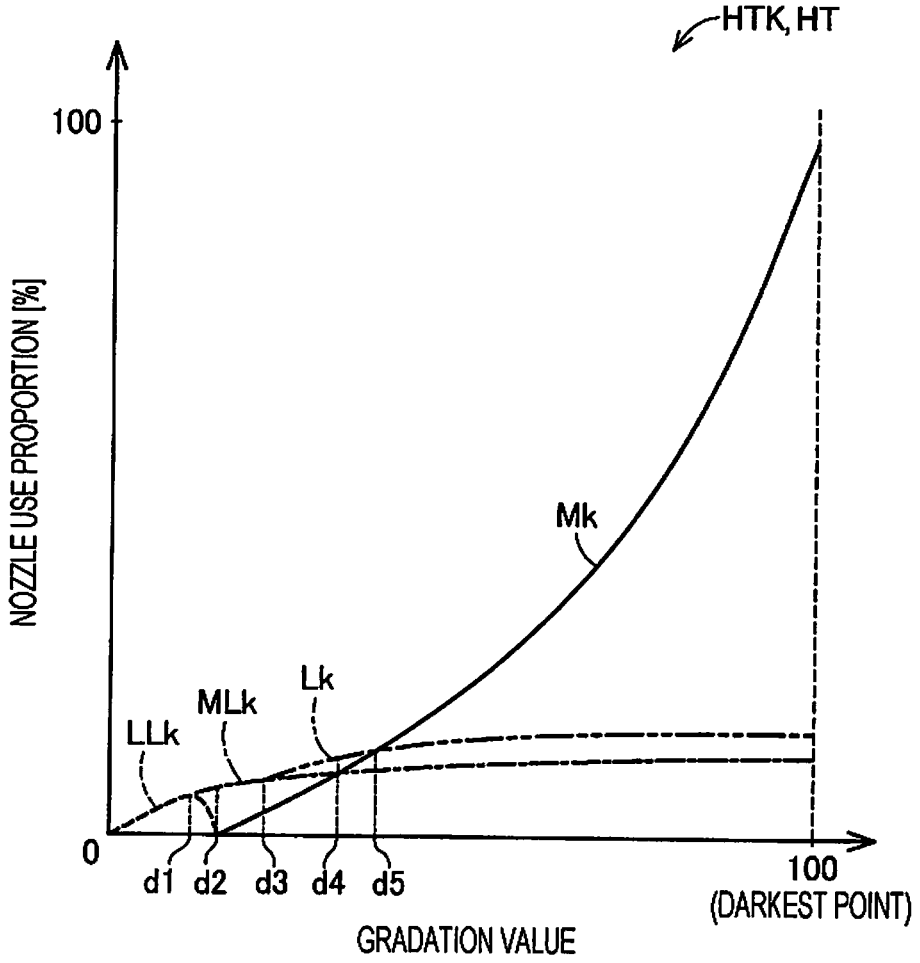
FIG. 4 is an explanatory diagram illustrating an example of a half tone table.

FIG. 4 is an explanatory diagram illustrating an example of the half tone table HT used by the half tone processing portion 43. A relationship of nozzle use proportion to gradation value of each color expressed in the printed image is set in the half tone table HT. "Nozzle use proportion" is referred to as nozzle duty and is a parameter representing the degree of driving frequency (ink discharge amount) of each nozzle 69 when any color of the image area is formed. More specifically, the nozzle use proportion is represented by a percentage of the actual ink discharge amount of the nozzle to the maximum value of ink amount which is capable of discharging per unit area by the nozzle 69 in one pass. Usually, in a case where the nozzle use proportion is high, the frequency of which ink droplets having large size being discharged is high and in a case where the nozzle use proportion is low, the frequency of which ink droplets having small size being discharged is high. A table for each color of magenta (M), yellow (Y), and black (K) is used. In FIG. 4, the half tone table HTK with respect to K is illustrated as an example. In FIG. 4, d1 to d5 which is represented in a gradation value axis are real numbers that satisfy the relationship of $0<d1<d2<d3<d4<d5<100$.

According to the half tone table HTK, in a range of the gradation value of K being equal to or less than d1, LLk is gradually more discharged as the gradation value is increased. In addition, in a range of the gradation value of K being equal to or greater than d1 and being less than d2, MLk is discharged in addition to LLk. However, in this range, the discharge amount of MLk is larger than the discharge amount of LLk. In addition, as the gradation value of K is increased, the discharge amount of MLk is gradually increased while the discharge amount of LLk is decreased markedly. In a range of the gradation value of K being equal to or greater than d2 and being less than d3, the discharge amount of LLk becomes 0 and Mk starts to be discharged in addition to MLk. In this range, the discharge amount of MLk is larger than the discharge amount of Mk. However, the nozzle use proportion of Mk has a high increasing rate with respect to the gradation value than the nozzle use proportion of MLk.

In a range of the gradation value of K being equal to or greater than d3, Lk starts to be discharged, in addition to MLk and Mk. In a range of the gradation value of K being equal to or greater than d3 and being less than d4, the discharging amount is increased in the order of Lk, MLk, and Lk. In addition, the increasing rate of the nozzle use proportion to the gradation value is increased in the order of MLk, Lk, and Mk. In a range of the gradation value of K being equal to or greater than d4 and being less than d5, the discharge amount of Mk is equal to or greater than the discharging amount of MLk. However, the discharging amount of Lk is still larger than the discharging amount of Mk and MLk and with respect to the increasing rate of the nozzle use proportion to the gradation value, the increasing rate of Mk is maximized. In a range of the gradation value of K being equal to or greater than d5, the nozzle use proportion of Mk is equal to or greater than the nozzle use proportion of Lk and the discharging amount of Mk is maximized. With respect to the increasing rate of the nozzle use proportion to the gradation value the increasing rate of Mk is maintained at a high increasing rate after the gradation value d2 while the increasing rates of Lk and MLk are low.

Therefore, in the half tone table HTK according to the present embodiment, a range of the gradation value of Lk and MLk along with Mk discharging is set. More specifically, at least, in a range of the gradation value in which the nozzle use proportion of Mk including the darkest point in which the nozzle use proportion of Mk is 100% is equal to or greater than 50%, the nozzle use proportion of Lk and MLk becomes greater than 0%. Therefore, in the half tone processing according to the present embodiment, with respect to the image area including at least the image area of the darkest point of the image area in which a black gradation expression is included, ink of three types of Mk, Lk, and MLk is set to be used. In addition, even in the image area which includes the image area of the gradation value which is close to the darkest point (for example, gradation value in which black is equal to or greater than 50), ink of three types of Mk, Lk, and MLk is set to be used. In the image area, Mk is continuously discharged as ink droplets having a large size and, in addition, the ink droplets having small sizes of Lk and MLk are discharged as assistance. Generation of density unevenness including wind ripple is suppressed by discharging ink droplets by such a combination in the printed image in which black ink is used as described as below.

Figure 5:
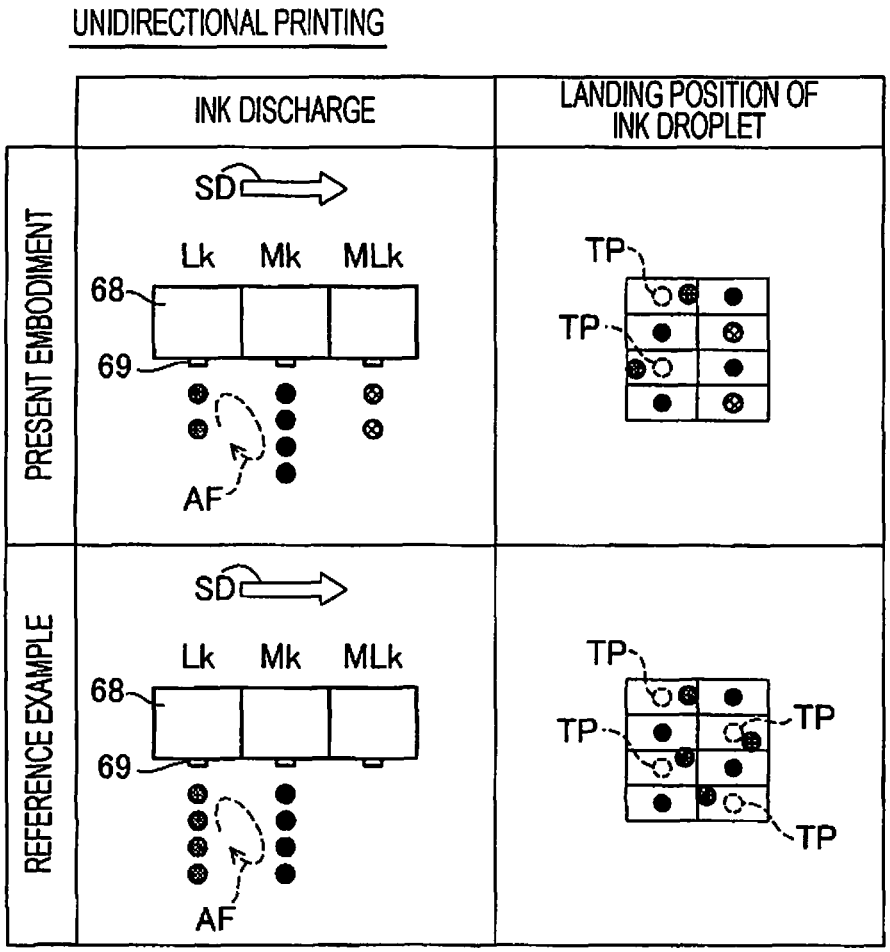
FIG. 5 is an explanatory diagram illustrating a suppressing mechanism of generation of wind ripple when unidirectional printing is performed.
Figure 6:
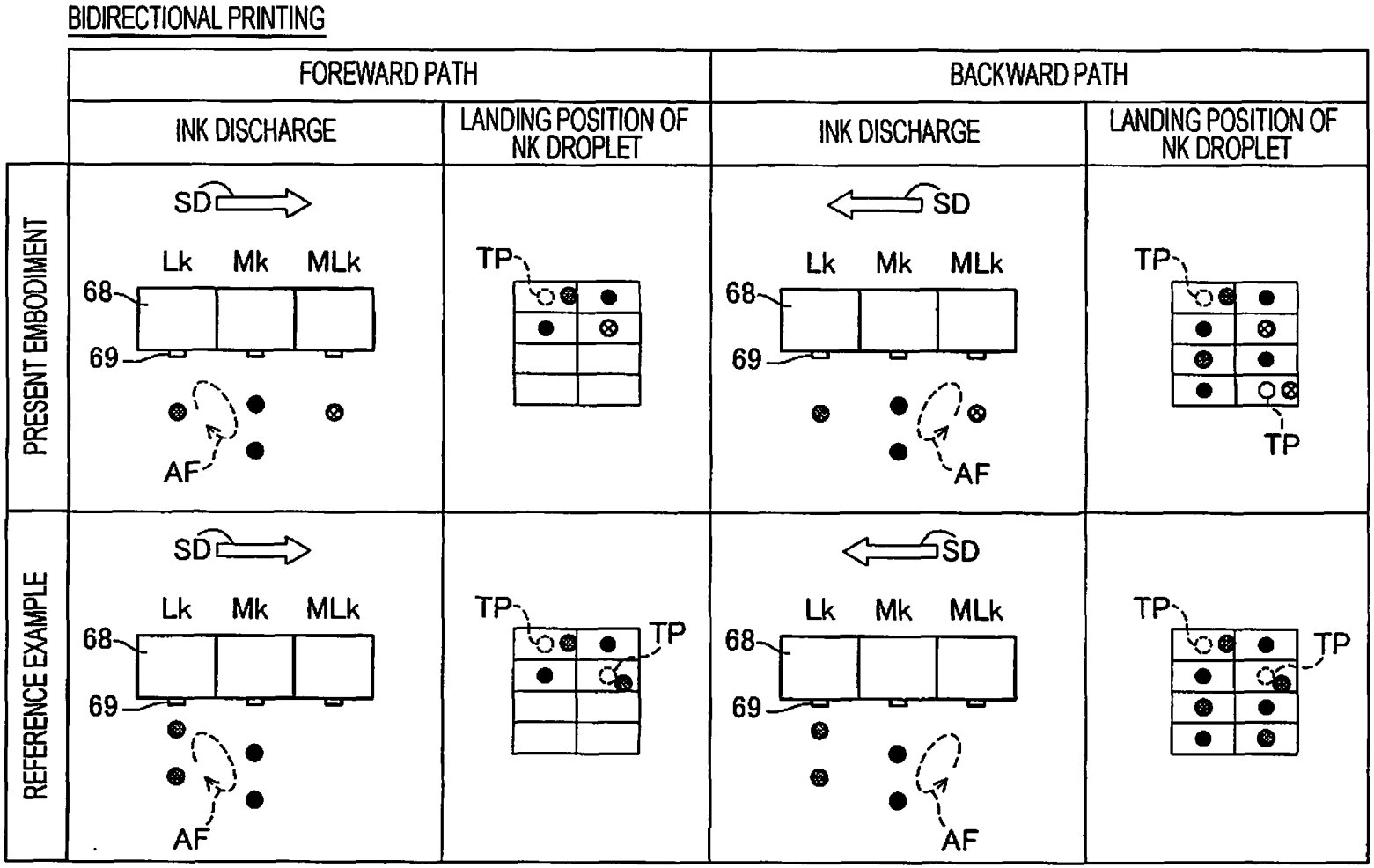
FIG. 6 is an explanatory diagram illustrating a suppressing mechanism of generation of wind ripple when bidirectional printing is performed.

With reference to FIG. 5 and FIG. 6, a mechanism of effect of suppressing of generation of density unevenness in the image forming apparatus 10 according to the present embodiment will be described. A view schematically showing a state of ink droplets of Mk, Lk, and MLk being discharged from the nozzles 69 of the head unit 68 according to the present embodiment is illustrated in a column of "ink discharge" of the left side of the paper surface in FIG. 5 and FIG. 6. Illustration of nozzles other than the nozzles 69 of Mk, Lk, and MLk in the head unit 68 is omitted in the column of "ink discharge" for convenience. In addition, irrespective of the size of the ink droplet, the size of the ink droplets is substantially uniformly shown. The recording result of dots by the discharge is schematically illustrated in the column of "landing position of ink droplets" of the right side of the paper surface in FIG. 5 and FIG. 6. Squares which show the area to which formation of dots is assigned are illustrated for convenience in the column of "landing position of ink droplets" and the dots are shown in a substantially uniform size, regardless of whether or not the size is large or small. In FIG. 5, an example of when the unidirectional printing is performed is illustrated. An example of when the bidirectional printing is performed is illustrated in FIG. 6, and when the head unit is moved in the forward path direction and when the head unit is moved in the backward path direction are separately illustrated. In addition, as a reference example, a case where the types of used ink are Mk and Lk is illustrated in the lower part of the present embodiment, in FIG. 5 and FIG. 6, respectively. In the reference example, the discharging amount of Mk is not different from that in the present embodiment, and the discharging amount of Lk is set to be the same as the sum of the discharge amounts of Lk and MLk in the present embodiment. An arrow SD which is illustrated in the column of "ink discharge" in FIG. 5 and FIG. 6 represents moving direction of the head unit 68 and a dashed arrow AF represents large disturbance of airflow which is generated between the head unit 68 and the printing paper PP. In addition, a circular area TP which is illustrated by a dashed line in the column of "landing position of ink droplets" originally represents the target formation position of the target dot. In FIG. 5 and FIG. 6, there is a case where a ratio of the number of ink droplets of Mk and the number of ink droplets other than Mk is different from the actual ratio.

First, with reference to FIG. 5, at the time of the unidirectional printing being performed will be described. As illustrated above, black gradation expression is included in the image forming apparatus 10 according to the present embodiment and Lk and MLk representing gray are used as assistance along with Mk including black color material with respect to an image area having high density. For those image areas, low density valleys are buried in the printed image by the gray dot being added as assistance in order not to overlap black dots and thus generation of density unevenness is suppressed. Therefore, appearance color is changed in black gradation expression and generation of so-called color transition can be suppressed by Lk and MLk which are achromatic color are used as an assisting ink in the black gradation expression. In particular, in the present embodiment, decrease in density of the printed image is also suppressed since combination of Lk having the first highest density of ink representing gray and MLk having the second highest density with each other is used. In addition, in the present embodiment, the deviation of the landing position of the ink droplets having a small size by the disturbance of air flow which is generated between the head unit 68 and the printing paper PP is suppressed and the generation of the density unevenness is further suppressed in the printed image.

The disturbance of air flow due to wind pressure which is generated by movement of the head unit 68 and wind pressure which is generated when the ink droplets is discharged from the head unit 68 is generated between the head unit 68 and the printing paper PP. In particular, in an area of lower side of the nozzle 69 of Mk in which high nozzle use proportion and large discharge amount of ink are assumed, air wall also called as air curtain is likely to be formed by air flow accompanying discharge of ink droplets of Mk having a large size. The larger disturbance of air flow is likely to be generated as illustrated by the arrow AF in an area of a downstream side in the moving direction of the head unit 68, since air flow which is generated by movement of the head unit 68 to the air wall is blocked. It is considered that this disturbance of the air flow gradually increases as the discharge amount of Mk increases and it is also considered that the disturbance of the air flow gradually has the largest size when the image area having the darkest point is formed.

In a case of the reference example, ink droplets having a small size is discharged from only the nozzle 69 of Lk which is positioned on the downstream side of the nozzle 69 of Mk as an assistance of ink droplets of Mk. Therefore, formation position of the dots of Lk is deviated and the wind ripple is likely to be generated in the printed image by the influence of the disturbance of the air flow described above. On the contrary, in a case of the present embodiment, at least the deviation of the formation position of dot of MLk is suppressed since the ink droplets having a small size are also discharged from the nozzle 69 of MLk which is positioned on the upstream side of the nozzle 69 of Mk. Accordingly, the generation of the wind ripple in the printed image by influence of the disturbance of the air flow is further suppressed than the case of the reference example. Therefore, in the unidirectional printing according to the present embodiment, the generation of the decrease in density and the density unevenness of the printed image are suppressed in the image area in which Lk and MLk are used as assistance, in addition to Mk including black color material.

Next, with reference to FIG. 6, the bidirectional printing being performed will be described. In a case of the present embodiment, when the head unit 68 is moved in the forward path direction, the nozzle 69 of MLk is positioned on the upstream side of the nozzle 69 of Mk. On the other hand, when the head unit 68 is moved in the backward path direction, the nozzle 69 of Lk is positioned on the upstream side of the nozzle 69 of Mk. In other words, any nozzle 69 of the Lk or MLk is positioned on the upstream side with respect to the nozzle 69 of Mk, even if the moving direction of the head unit 68 is switched, during one pass. Accordingly, variations in the image quality of the printed image by the difference in the moving direction of the head unit 68 are suppressed. On the contrary, in a case of the reference example, when the head unit 68 is moved in the forward path direction, the nozzle 69 of Lk is positioned on the downstream side of the nozzle 69 of Mk and when the head unit 68 is moved in the backward path direction, the nozzle 69 of Lk is positioned on the upstream side of the nozzle 69 of Mk. Accordingly, variations in the image quality of the printed image by the difference in the moving direction of the head unit 68 can be generated. Accordingly, in the bidirectional printing according to the present embodiment, effect of suppression of generation of variations in the image quality due to difference in the moving direction of the head unit 68 can be obtained, in addition to the effects of suppression of generation of decrease in density or the density unevenness in the printed image.

FIG. 7 and FIG. 8 are explanatory diagrams which illustrate evaluation results of the printed images which are formed by the image forming apparatus 10 according to the present embodiment. FIG. 7 and FIG. 8 illustrate each evaluation result when predetermined beta images in which the nozzle use proportion of each of Mk, Lk and MLk is changed and which are evaluating targets and have the same sizes are formed. FIG. 7 is an evaluation result when being formed by the unidirectional printing and FIG. 8 is an evaluation result when being formed by the bidirectional printing. In "density evaluation", "A" represents that an average value of OD values which is measured in 10 measuring points in the beta images arrayed at predetermined intervals is equal to or greater than a predetermined reference value and "B" represents that the average value is less than the predetermined reference value. "Unevenness evaluation" represents visual evaluation results of the beta images which are evaluation targets. In "unevenness evaluation", "A" represents that the density unevenness is scarcely observed, "B" represents that density unevenness is generated within an allowable range, and "C" represents that the density unevenness exceeding the allowable range is generated. In a case where both of the density evaluation and the unevenness evaluation are "A", "overall evaluation" becomes "A" and in a case where any one of the density evaluation and the unevenness evaluation is not "A", "overall evaluation" becomes "B".

As represented in the evaluation results of FIG. 7 and FIG. 8, the nozzle use proportion of Lk is desirably equal to or greater than 5%, in order to suppress the decrease in density and the density unevenness of the printed image. In addition, similarly, the nozzle use proportion of MLk is desirably equal to or greater than 5%. In order to satisfy the reference density of the printed image, the nozzle use proportion of LK is desirably less than 20% and is more desirably equal to or less than 15%. Similarly, the nozzle use proportion of MLk is desirably less than 20% and is more desirably equal to or less than 15%. The nozzle use proportion of Mk is desirably equal to or greater than 90% and is more desirably equal to or greater than 95%. Although not represented in the evaluation results of FIG. 7 and FIG. 8, it is inferred that good results can be obtained even at 100% in the nozzle use proportion of Mk.

As described above, according to the image forming apparatus 10 of the present embodiment, at least, the decrease in density and generation of the density unevenness can be suppressed when the gradation of black is expressed in the printed image. Also, according to the image forming apparatus 10 of the present embodiment, following various effects can be achieved. Mk and Pk are switched, as ink including the black color material, according to the type of the printing paper PP in the image forming apparatus 10 of the present embodiment. Accordingly, black color can be more suitably expressed according to the type of the printing paper PP and the image quality of the printed image can be increased. The effect described above of suppression of generation of the decrease in density or the density unevenness by using Mk, Lk and MLk can be similarly obtained even in a case where Mk is replaced with Pk.

According to the image forming apparatus 10 of the present embodiment, the gradation expression ability of black can be increased and the image quality of the printed image can be increased since LLk is used as ink representing gray, in addition to Lk and MLk. In addition, in the present embodiment, the nozzle array 69*s* of LLk is positioned with the nozzle array 69*s* of MLk being positioned between the nozzle array 69*s* of LLk and the nozzle arrays 69*s* of Mk and Pk in the main scanning direction (FIG. 2). Therefore, generation of color mixing by Mk and Pk entering the nozzle 69 of LLk is suppressed and thus degradation of the printed image is suppressed.

In the image forming apparatus 10 of the present embodiment, the nozzle arrays 69*s* of the chromatic color ink Lc, Ma, Ye, Cy and La are provided on both sides of the nozzle arrays 69*s* of the achromatic color ink Mk, Pk, Lk, MLk, and LLk (FIG. 2) in the main scanning direction. Accordingly, the nozzle arrays 69*s* of the chromatic color ink Lc, Ma, Ye, Cy and La can be frequently used and can be provided on a position which is spaced apart from the nozzle arrays 69*s* of Mk and Pk which have a high generation frequency of the wind pressure accompanying discharge of ink. Accordingly, it can be suppressed that trajectory of the ink droplets of chromatic color ink Lc, Ma, Ye, Cy, Lm are affected by wind pressure accompanying the discharge of the ink droplets of Mk and Pk and thus the generation of the density unevenness is suppressed. In addition, the mixing of Mk and Pk into the nozzles 69 of the chromatic color ink Lc, Ma, Ye, Cy, and Lm is suppressed and degradation of the printed image due to color mixture is suppressed.

B. Modification Example:

B1. Modification Example 1:

In the half tone processing of the present embodiment, at least, Lk and MLk is set to be discharged, as ink in order to assist Mk and Pk, with respect to the color data of the darkest point. On the contrary, in the half tone processing, ink other than Lk and MLk may be set to be discharged, as ink in order to assist Mk and Pk, with respect to the color data of the darkest point. For example, ink such as LLk, Cy and Ma which are chromatic color may be set to be discharged along with Mk or Pk. In addition, ink of another color may be set to be discharged, in addition to Lk and MLk, as ink for assisting Mk and Pk.

B2. Modification Example 2:

In the present embodiment, the nozzle array 69*s* of Lk and the nozzle array 69*s* of MLk are provided with the nozzle arrays 69*s* of Mk and Pk being disposed between the nozzle array 698 of Lk and the nozzle array 698 of MLk in the main scanning direction. On the contrary, the nozzle array 69*s* of Lk and the nozzle array 698 of MLk are provided in the same side with respect to the nozzle arrays 69*s* of Mk and Pk in the main scanning direction. In this case, any one of the nozzle array 698 of Lk and the nozzle array 69*s* of MLk is provided at a position which is spaced apart from by at least one array of the nozzle arrays 69*s* with respect to the nozzle arrays 69*s* of Mk and Pk. In other words, any one of the nozzle array 69*s* of Lk and the nozzle array 69*s* of MLk is provided at a position in which the influence of disturbance of air flow which is generated according to the discharge of ink in the nozzle 69 of Mk and Pk is reduced. Accordingly, the generation of the density unevenness by the influence of the wind pressure accompanying the discharge of the ink droplets having a large size is suppressed in the nozzles 69 of Mk and Pk.

B3. Modification Example 3:

The image forming apparatus 10 in the present embodiment is capable of selectively performing the unidirectional printing and the bidirectional printing. On the contrary, the image forming apparatus 10 may be capable of performing only the unidirectional printing or only the bidirectional printing conversely.

B4. Modification Example 4:

The image forming apparatus 10 of the present embodiment is configured to be capable of discharging Mk and Pk which are ink including two types of black color material which is used differently for each type of the printing paper PP. On the contrary, the image forming apparatus 10 may be configured to be capable of discharging only ink including one type of black color material, regardless of the type of the printing paper PP.

B5. Modification Example 5:

In the present embodiment, the head unit 68 has the nozzle arrays 69*s* of Lk, MLk and LLk which represent gray which is intermediate gradation of black. On the contrary, the head unit 68 may not include all of the nozzle arrays 69*s* of Lk, MLk, and LLk or may not include a portion of the nozzle arrays 69*s* of Lk, MLk, and LLk. For example, the head unit 68 may not include the nozzle array 69*s* of LLk. In addition, further, the head unit 68 may include a nozzle array 69*s* of ink of gray having different density or may include a nozzle array 69*s* of ink of gray having substantially same density, in addition to Lk, MLk, and LLk.

B6. Modification Example 6:

In the present embodiment, the head unit 68 includes the nozzle arrays 69*s* of chromatic color ink Lc, Ma, Ye, Cy, and La. On the contrary, the head unit 68 may not include all the nozzle arrays 69*s* of chromatic color ink Lc, Ma, Ye, Cy, and Lm. For example, the head unit 68 may not include the nozzle arrays 69*s* of Lc and Lm. Alternatively, the head unit 68 may further include a nozzle array 69*s* of another color ink in addition to chromatic color ink Lc, Ma, Ye, Cy, and Lm.

B7. Modification Example 7:

In the head unit 68 according to the present embodiment, the nozzle arrays 69*s* of Lk, Mk, Pk, MLk and LLk may be provided between the nozzle arrays 69*s* of Lc, Ma, and Ye and the nozzle arrays 69*s* of Cy and Lm in the main scanning direction. On the contrary, the formation position of the nozzle arrays 69*s* of chromatic color ink Lc, Ma, Ye, Cy, and Lm may not limited to the position. For example, the nozzle array 69*s* of Lc may be provided between the nozzle arrays 69*s* of Lk and Mk in the main scanning direction and the nozzle array 69*s* of Ma may be provided between the nozzle arrays 69*s* of Mk and MLk in the main scanning direction.

B8. Modification Example 8:

In the present embodiment, the image forming apparatus 10 is configured as an ink jet printer. On the contrary, the image forming apparatus 10 may not be configured as the ink jet printer and the image forming apparatus 10 may be configured as an apparatus for forming an image which discharges ink on a medium based on the image data. In addition, in the present embodiment, the image forming apparatus 10 includes a configuration in which the image processing unit 20 and the recording unit 60 are integrated with each other. On the contrary, the image forming apparatus 10 may include a configuration in which the image processing unit 20 and the recording unit 60 are separated from each other.

The invention is not limited to the present embodiments, the examples and the modification examples described above and can be realized in various configurations within the scope without deviating from the gist thereof. For example, the technical features in the present embodiments, the examples, and modification examples corresponding to the technical features in each aspect described in the summary of the invention can be replaced or combined as appropriate in order to solve some or all of the above problems, or in order to achieve some or all of the effects described above. In addition, unless technical features of the invention are described as essential in this specification, it can be deleted as appropriate.

This application claims priority under 35 U.S.C. § 119 to Japanese Patent Application No. 2016-033254, filed Feb. 24, 2016. The entire disclosure of Japanese Patent Application No. 2016-033254 is hereby incorporated herein by reference.

What is claimed is:

1. An image forming apparatus that forms an image on a medium based on image data, the image forming apparatus comprising:

a head unit that moves in a predetermined scanning direction and on which a first nozzle which discharges first ink including a black color material and having a brightness, a second nozzle which discharges second ink having a brightness that is higher than the brightness of the first ink, and a third nozzle which discharges third ink having a brightness that is higher than the brightness of the first ink are arrayed in the scanning direction, the first, second and third inks having achromatic color, the brightness of the second ink being different from the brightness of the third ink; and a control portion that performs image forming processing which forms the image on the medium by discharging ink from the head unit and thus forming dot array while moving the head unit in the scanning direction, wherein the control portion performs a conversion process which sets a type and an amount of the ink which is discharged from the head unit according to color data included in the image data and which sets to use all of the first ink, the second ink, and the third ink for the darkest point of the color data.

2. The image forming apparatus according to claim 1, wherein the first nozzle is positioned between the second nozzle and the third nozzle in the scanning direction.

3. The image forming apparatus according to claim 1, wherein, in a case where the scanning direction is a first scanning direction and a direction which is opposite to the first scanning direction is a second scanning direction, the control portion selectively performs a first image forming processing that forms the image by discharging the ink from the head unit, only while moving the head unit in the first scanning direction, and a second image forming processing that forms the image by combining a first scanning processing which discharges the ink from the head unit while moving the head unit in the first scanning direction and a second scanning processing which discharges the ink from the head unit while moving the head unit in the second scanning direction.

4. The image forming apparatus according to claim 1, wherein, in a case where an actual proportion of a discharging amount of ink of the nozzle per a unit area to the maximum value of ink amount which is capable of being discharged per the unit area on the medium from the same nozzle is used as a nozzle use proportion, the nozzle use proportion in the second nozzle is 5% to 15%, when the image area having the darkest point is formed.

5. The image forming apparatus according to claim 1, wherein, in a case where an actual proportion of a discharging amount of ink of the nozzle per a unit area to the maximum value of ink amount which is capable of being discharged per the unit area on the medium from the same nozzle is used as a nozzle use proportion, the nozzle use proportion in the third nozzle is 5% to 15%, when the image area having the darkest point is formed.

6. The image forming apparatus according to claim 1, wherein, in a case where an actual proportion of a discharging amount of ink of the nozzle per a unit area to the maximum value of ink amount which is capable of being discharged per the unit area on the medium from the same nozzle is used as a nozzle use proportion, the nozzle use proportion in the first nozzle is 90% to 100%, when the image area having the darkest point is formed.

7. The image forming apparatus according to claim 1, wherein the head unit further includes a fourth nozzle which discharges a fourth ink including black color material, and wherein the control portion selects the fourth ink as ink in place of the first ink, based on the type of the medium.

8. The image forming apparatus according to claim 1, wherein the head unit further includes a fifth nozzle which discharges a fifth ink of which density is lower than that of the third ink, and wherein the first nozzle is positioned between the second nozzle and the third nozzle and the third nozzle is positioned between the first nozzle and the fifth nozzle in the scanning direction.

9. The image forming apparatus according to claim 1, wherein the head unit further includes a first color ink nozzle which discharges a first ink having chromatic color and a second color ink nozzle which discharges a second ink having chromatic color, and wherein the first nozzle, the second nozzle, and the third nozzle are positioned between the first color ink nozzle and the second color ink nozzle in the scanning direction.

* * * * *